US011732535B2

(12) United States Patent
Quero et al.

(10) Patent No.: US 11,732,535 B2
(45) Date of Patent: Aug. 22, 2023

(54) MULTI-COMPONENT DOWNHOLE TREATMENT

(71) Applicant: Halliburton Energy Services, Inc., Houston, TX (US)

(72) Inventors: Philippe Quero, Houston, TX (US); Eric Bivens, Littleton, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/834,076

(22) Filed: Mar. 30, 2020

(65) Prior Publication Data

US 2020/0392802 A1 Dec. 17, 2020

Related U.S. Application Data

(63) Continuation of application No. PCT/US2019/037032, filed on Jun. 13, 2019.

(51) Int. Cl.
*E21B 17/18* (2006.01)
*E21B 43/16* (2006.01)
*E21B 17/20* (2006.01)

(52) U.S. Cl.
CPC ..... *E21B 17/18* (2013.01); *E21B 17/203* (2013.01); *E21B 43/16* (2013.01); *E21B 43/166* (2013.01)

(58) Field of Classification Search
CPC ..... E21B 17/18; E21B 17/203; E21B 43/16; E21B 43/166
See application file for complete search history.

(56) References Cited

U.S. PATENT DOCUMENTS 3,157,232 A * 11/1964 Ramos ..... C09K 8/72 166/300
3,727,691 A * 4/1973 Muecke ..... E21B 43/25 166/295
4,064,941 A 12/1977 Smith
10,851,620 B2 * 12/2020 Hoffman ..... E21B 33/12
2005/0199390 A1 9/2005 Curtice et al.
(Continued)

FOREIGN PATENT DOCUMENTS

WO 2002023010 A1 3/2002
WO 2015155589 A1 10/2015

OTHER PUBLICATIONS

PCT Application Serial No. PCT/US2019/037032, International Search Report, dated Mar. 5, 2020, 3 pages.
(Continued)

*Primary Examiner* — D. Andrews
(74) *Attorney, Agent, or Firm* — Delizio, Peacock, Lewin & Guerra

(57) ABSTRACT

A downhole treatment system, apparatus, and methods are disclosed. In some embodiments a treatment apparatus includes a first conduit configured to transport a first fluid from a first fluid source through a first enclosed channel to a first outlet. A second conduit is configured to transport a second fluid from a second fluid source through a second enclosed channel to a second outlet. The treatment apparatus further comprises a mixing applicator that includes the first outlet positioned to provide a discharge path for the first fluid that at least partially intersects a flow path of the second fluid within a confluence region within or external to the second conduit.

20 Claims, 7 Drawing Sheets

(56) References Cited

U.S. PATENT DOCUMENTS

| | | | | |
|---|---|---|---|---|
| 2007/0137858 | A1 | 6/2007 | Considine et al. | |
| 2007/0215356 | A1 | 9/2007 | Leeb | |
| 2009/0205821 | A1* | 8/2009 | Smith | C09K 8/685 166/250.01 |
| 2010/0063639 | A1* | 3/2010 | Gothard | G05D 21/02 700/282 |
| 2010/0108311 | A1* | 5/2010 | Daussin | E21B 47/07 166/250.01 |
| 2010/0294493 | A1 | 11/2010 | Goodwin et al. | |
| 2011/0155390 | A1 | 6/2011 | Lannom et al. | |
| 2011/0209869 | A1* | 9/2011 | Smith | E21B 43/243 166/260 |
| 2013/0277047 | A1* | 10/2013 | Kuhn de Chizelle | E21B 17/203 166/250.12 |
| 2015/0233530 | A1* | 8/2015 | Sandidge | E21B 43/16 137/565.11 |
| 2016/0108697 | A1* | 4/2016 | Abbad | C09K 8/516 166/292 |
| 2018/0230780 | A1* | 8/2018 | Klenner | E21B 43/121 |
| 2019/0162051 | A1* | 5/2019 | Hoffman | E21B 41/00 |

OTHER PUBLICATIONS

PCT Application Serial No. PCT/US2019/037032, International Written Opinion, dated Mar. 5, 2020, 6 pages.

"EP Application No. 19932990.5, Extended European Search Report", dated Oct. 21, 2022, 6 pages.

* cited by examiner

MULTI-COMPONENT DOWNHOLE TREATMENT

BACKGROUND

During or following drilling, post-drilling, and production phases, several types of downhole treatment operations may be performed. Some such downhole treatment operations may entail transporting and applying fluids or semi-fluid composite materials such as chemical treatments and slurries downhole. For example, a cement slurry comprising multiple distinct and mutually reactive liquids as well as solid components may be delivered via a tubular conduit such as a wellbore casing. To cement the casing within surrounding earth material, the cement is pressure driven downward through the bottom of the casing and up into an annular channel between the outside of the casing and the surrounding earth material. Other downhole treatments entail application of composite fluids such as sealing materials delivered through tubular injection strings. The composite mixtures are typically formed at the surface where mixing devices are utilized to combine the various components prior to the resultant mixture being transported downhole via an injection string. For some applications, multiple components may be delivered sequentially through the injection string, using dart plugs to separate quantities of the respective fluid components.

BRIEF DESCRIPTION OF THE DRAWINGS

Embodiments of the disclosure may be better understood by referencing the accompanying drawings.

DESCRIPTION OF EMBODIMENTS

Figure 1:
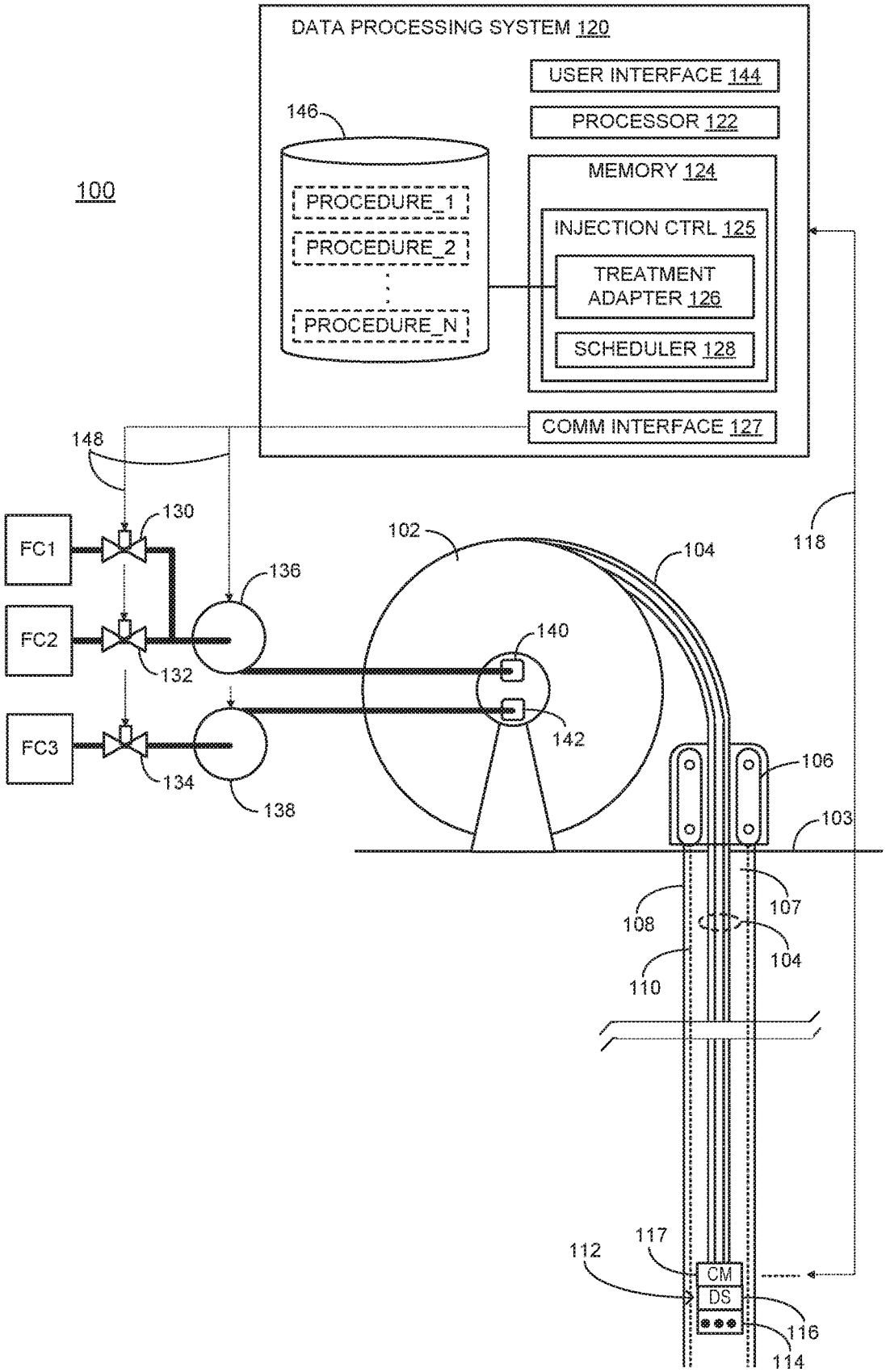
FIG. 1 is a block diagram depicting a multi-component treatment system configured and implemented within a well system in accordance with some embodiments.

The description that follows includes example systems, methods, techniques, and program flows that embody embodiments of the disclosure. However, it is understood that this disclosure may be practiced without one or more of these specific details. In other instances, well-known instruction instances, protocols, structures and techniques have not been shown in detail in order not to obfuscate the description.

Overview

Wellbore construction and maintenance during drilling, testing, and production may include treatment operations that require delivery of fluids, such as liquids, slurries, and other types of liquid/fluid mixtures to specified downhole sites. Such composite fluids and mixtures sometimes include individual material components that are mutually reactive in a manner that is time-sensitive and/or sensitive to environmental conditions such as temperature and pressure. In such cases, the mixing and placement of such combined composite material is likewise time-sensitive and/or sensitive to environmental conditions such as temperature and pressure.

Embodiments disclosed herein include systems, devices, components, operations, and functions operatively configured to deliver the composite materials by individually transporting the constituent components or combinations of such components. Each of two or more fluid components may be transported over separate flow paths until the components reach a mixing applicator. The transport of the components may be based on a transport and mixing schedule that may be derived, in part, from a treatment procedure. For transport, an injection string includes multiple fluid conduits each transporting a respective fluid component comprising a uniform liquid substance or a mixture of liquid and dissolved or suspended particulate substance(s). For mixing, the injection string includes a mixing applicator that includes outlets of the two or more of the fluid conduits mutually positioned to provide one or more intersecting discharge paths. One or more flow pressure devices, such as fluid pumps, are operably configured to apply flow pressure within the fluid conduits to transport the fluids to a mixing applicator. As utilized herein, a "fluid component" refers to a liquid or gaseous material that includes one or more distinct chemical components such as distinct elements, compounds, etc. Furthermore, a fluid component may comprise a homogeneous or heterogeneous liquid mixture that may be entirely fluid (purely a combination of liquid and dissolved solids) or may contain undissolved solids immersed within fluid.

In some embodiments, a method for placing a multi-component fluid treatment comprises driving a first fluid component through a first conduit to a first outlet and driving a second fluid component through a second conduit to a second outlet. The second conduit is coextensively disposed in substantially parallel proximity with the first conduit. The first and second fluid components are combined within a confluence region that includes at least a portion of a discharge flow path from the first outlet. An injection delivery program is configured to control timing of discharge of the respective fluid components from each of the fluid conduits such as by controlling the respective timing of initial transport and the pressures at which the fluids are pumped downhole.

Example Illustrations

FIG. 1 is a high-level diagram depicting a treatment system 100 configured and implemented within a well system in accordance with some embodiments. Treatment system 100 includes subsystems, devices, and components configured to apply a multi-component treatment using delivery systems and components that transport and mix the multiple fluid components and discharge the mixture at one or more treatment sites. Treatment system 100 includes a coiled tubing apparatus that comprises, in part, coiled tubing 104 that is initially coiled onto a cylindrical drum 102. Coiled tubing 104 comprises relatively flexible, continuous tubing that is withdrawn from cylindrical drum 102, which may be mounted on a truck or other support structure. Coiled tubing 104 may be inserted downhole for substantial lengths before requiring a joining operation to connect another strand of coiled tubing, thereby saving considerable time by comparison to jointed pipe. Coiled tubing 104 is typically inserted into and withdrawn from a wellbore 107 using a tubing injector 106.

Coiled tubing 104 is a multi-tube tubing string comprising multiple, parallel lengths of tubing that each form a distinct fluid flow conduit. Each tube/conduit within coiled tubing 104 may comprise, for example, continuous steel and/or aluminum alloy tubing strings. For example, each of the tubes within coiled tubing 104 may range in length from 1,000 to 15,000 feet. Each of the conduits within coiled tubing 104 may have an outside diameter of from about 1 inch to about 4.5 inches. In some embodiments, each of the conduits within coiled tubing 104 is generally a cylindrical or tubular-like structure each having a respective axial flowbore. Coiled tubing 104 may be formed of single or composite material as would be appreciated by one of skill in the art such as steel, aluminum, copper, and various metallic alloys, as well as a number of non-metallic compounds, such as fiberglass, plastic, polyurethane, or other materials, or a combination of metallic and non-metallic materials.

Coiled tubing 104 is configured as an injection string that includes two or more separate fluid flow paths. Coiled tubing 104 is configured, using various input, output, and intermediary connections, to transport each of two or more individual fluid components to one or more downhole positions proximate to treatment sites. As depicted and described in further detail with reference to FIGS. 2, 3, 4, 5, 6, 7, 8, and 9, coiled tubing 104 comprises multiple, separate fluid conduits through which each of a respective one or more fluid components are pumped to a downhole treatment tool 112 that is coupled to a distal end of coiled tubing 104. Treatment tool 112 includes a mixing applicator 114 that is configured to mix and discharge the combination of fluid components at a downhole treatment site.

To position and re-position treatment tool 112, coiled tubing 104 is injected and withdrawn by a tubing injector 106 through a wellbore 107 formed within a borehole surface 108. In some embodiments, wellbore 107 may be a fully or partially uncased wellbore. In FIG. 1, a casing 110 is concentrically disposed within wellbore 107 to line borehole surface 108. Treatment tool 112 is selectively positioned within wellbore 107 such that mixing applicator 114 is positioned to mix and discharge fluid components from the fluid conduits at one or more treatment sites. In some embodiments, flow control in one or more of the fluid conduits is implemented, at least in part, by flow control devices such as pumps and valves. Individual and/or combined flow control for one or more of the fluid conduits within coiled tubing 104 may be implemented by automated or manual user inputs based, for example, on treatment site environment information obtained from surface and/or subsurface sensors and gauges. In the same or alternate embodiments, some or all of the flow control associated with downhole treatment may be implemented, at least in part, by programmed scheduler components that utilize treatment site or other down hole environment information in combination with treatment-specific information.

Treatment tool 112 may further include a control module 117 and one or more downhole sensors 116 that may be positioned at one or more positions including proximate mixing applicator 114. The downhole sensor 116 within treatment tool 112 is configured, using various electronics components, to measure and record downhole parameters such as the position and orientation of treatment tool 112. Downhole sensor 116 may be further configured, using various sensor and support electronics components, to measure and record downhole environment conditions such as downhole pressure and temperature proximate treatment tool 112. Control module 117 includes electronic components for transmitting and receiving signals from a surface processing system, such as a data processing system 120 via a telemetry link 118. Control module 117 configures and reconfigures downhole sensor 116 based on measurement instructions received from data processing system 120. Control module 117 also transmits the sensor measurement information, such as pressure and/or temperature information, to data processing system 120. Telemetry link 118 includes transmission media and endpoint interface components configured to employ a variety of communication modes. The communication modes may comprise different signal and modulation types carried using one or more different transmission media such as acoustic, electromagnetic, and optical fiber media.

As shown, data processing system 120 may operate at or above a terrain surface 103 within or proximate to a well head apparatus, for example. Data processing system 120 includes processing and storage components configured to receive and process treatment procedure and downhole measurement information to generate flow control signals. Data processing system 120 comprises, in part, a computer processor 122 and memory device 124 configured to execute program instructions for generating the flow control signals. A communication interface 127 is configured to transmit and receive signals to and from treatment tool 112 as well as other devices within treatment system 100 including flow control devices.

Data processing system 120 is configured to control various fluid flow control components such as pumps and valves to enable coordinated transport, mixing, and discharge of combined fluid treatments at downhole treatment sites. Data processing system 120 may collect and utilize input information relating to fluid transport distance(s) and downhole environment conditions to determine schedules for transporting the various fluid components. To this end, data processing system 120 includes an injection control program 125 configured to process downhole measurement information collected and generated by downhole sensor 116 as well as input from a user interface 144. Injection control program 125 is configured, using a combination or program instructions and calls to control activation of flow control devices including a set of pumps 136 and 138. Some of all flow control operations may be performed in the absence or otherwise independently of control module 117 and/or downhole sensor 116. In such instances, the individual and/or combined flows through coiled tubing 104 and treatment tool 112 are controlled manually, based on treatment site or other downhole conditions interpreted from surface data.

Each of pumps 136 and 138 comprises a fluid transfer pump such as a positive-displacement pump. Each of pumps 136 and 138 is configured to drive fluid from a respective fluid component source through one of the fluid conduits within coiled tubing 104 and to a fluid stop point or through a discharge port within treatment tool 112. For example, pump 136 is configured to receive fluid from either or both first and second fluid component sources, FC1 and FC2. Pump 138 is configured to receive fluid from a third fluid component source, FC3. Pumps 136 and 138 are configured to drive input fluid from a respective one or more sources into a respective coiled tubing conduit via inlet ports 140 and 142, respectively. Ports 140 and 142 are fluid inlet and coupling devices disposed on or integral to a drum axis plate 137 that remains stationary as drum 102 rotates to release coiled tubing 104. Ports 140 and 142 are configured to mechanically couple the outlet lines from pumps 136 and 138 to inlets to the respective fluid conduits within coiled tubing 104.

Each of pumps 136 and 138 may include a control interface (not depicted) such as in the form of a locally installed activation and switching microcontroller that receives activation and switching instructions from data processing system 120 via a telemetry link 148. For instance, the activation instructions may comprise instructions to activate or deactivate the pump and/or to activate or deactivate pressurized operation by which the pump applies pressure to drive the fluid received from one or more of fluid sources, FC1, FC2, and FC3, to one of inlet ports 140 or 142. Switching instructions may comprise instructions to switch to, from, and/or between different fluid pumping modes. For instance, a switching instruction may instruct the target pump 136 and/or 138 to switch from low flow rate (low pressure) operation to higher flow rate (higher pressure) operation. By issuing coordinated activation and switching instructions to pumps 136 and 138, data processing system 120 controls and coordinates flows and flow rates of fluids from each of fluid sources FC1, FC2, and FC3 through the separate fluid conduits within coiled tubing 104. Additional flow control, including individual control of flow from the fluid sources FC1, FC2, and FC3 to pumps 136 and 138 is provided by electronically actuated valves 130, 132, and 134. Each of valves 130, 132, and 134 includes a control interface (not depicted) such as in the form of a locally installed microcontroller that receives valve position instructions from data processing system 120 via telemetry link 148. For instance, the valve position instructions may comprise instructions to open, close, or otherwise modify the flow control position of the valve. Individually, or in combination with pump operation instructions, data processing system 120 may control flow and rate of flow from each of fluid sources, FC1, FC2, and FC3.

An example downhole treatment operation or cycle may begin with a request submitted to data processing system 120 via user interface 144. For instance, user interface 144 may comprise a combination of hardware and software components for entering and translating user input instructions such as a selection of a specified downhole treatment. A variety of downhole treatments may be requested such as a cement casing request, a well casing repair, a formation sealing operation, etc. A downhole treatment request such as a menu selection that is input via user interface 144 is received and processed by a treatment adapter 126. Treatment adapter 126 is configured using any combination of program instructions to interpret the request and select a corresponding treatment procedure routine within a treatment procedure database 146. Each of the procedures, PROCEDURE_1 through PROCEDURE_N, within treatment procedure database 146 includes data that specifies relative concentrations of the fluid components and reaction periods for mixtures of the components utilized for a particular treatment. Treatment adapter 126 further includes instructions for requesting downhole parameters such as from downhole sensors 116 and generates relative timings for transporting and mixing the fluid components downhole based on downhole parameters and reaction periods specified by a selected one of PROCEDURE_1 through PROCEDURE_N.

For example, treatment adapter 126 may identify and select PROCEDURE_2 in response to a user interface request/selection. Each of the procedures, such as PROCEDURE_2, comprises data that specifies the constituent fluid components utilized for the requested treatment, the relative concentrations, and values or ranges of total individual and/or mixed volumes of the fluid material. The data within PROCEDURE_2 may further specify mixing parameters associated with two or more of the fluids or constituent components of two or more of the fluids. For instance, the data may specify one or more reactions periods associated with mixing two or more of the fluids.

The procedure data may further specify environmental factors such as temperatures and pressures that correspond to reaction periods for mixed fluid components. Based on the procedure data, treatment adapter 126 may request or otherwise acquire downhole parameter data such as fluid pressures within each of the fluid conduits and temperature and pressure proximate the treatment site. The downhole parameters may be measured by downhole sensors 116 and transmitted by control module 117 to data processing system 120. Treatment adapter 126 generates an adapted procedure that specifies the transport rates and periods for each of the fluid components to be transported to treatment tool 112 via a respective one of the fluid conduits within coiled tubing 104. In association with each of the specified transport rates and periods for each fluid component, the adapted procedure may specify a conduit fluid pressure.

Scheduler 128 comprises program code and data configured to generate a flow control schedule including mutually offset control signals for flow control devices such as pumps and valves. The schedule includes pump activation and switching signals and valve position signals that are mutually offset based on device operating capacities in combination with the flow rate information within the adapted procedure received from treatment adapter 126. In this manner, the schedule includes flow control signals that are issued at specified timing points to implement relative timing of pump, valve, and other flow control component operation required to implement the adapted treatment procedure. In some embodiments, scheduler 128 determines the relative timings of flow control device operation based on the overall flow control configuration.

The pump and valve control signals are transmitted via communications interface 127 to the control interfaces of pumps 136 and 138 and valves 130, 132, and 134 to implement coordinated flow of fluids from fluid sources FC1, FC2, and FC3 through the respective fluid conduits within coiled tubing 104. For example, scheduler 128 may be configured to identify a currently utilized flow control configuration in which valve 130 controls flow rate from fluid source FC1 to the inlet of pump 136, valve 132 controls flow rate from fluid source FC2 to the inlet of pump 136, and valve 134 controls flow rate from fluid source FC3 to the inlet of pump 138. Based on operating parameters of the pumps and valves and the adapted transport and mixing procedure, scheduler 128 generates and transmits activation and switching signals to the pump and valve components to implement the adapted procedure.

During execution of a downhole treatment, control instructions generated by scheduler 128 are transmitted to the respect flow control components. In response to the instructions, the flow control components, such as pumps 136 and 138, drive respective quantities of fluids from fluids sources FC1, FC2, and FC3 into respective fluid conduits within coiled tubing 104. The fluids are transported via the respective conduits to treatment tool 112. As depicted and described in further detail with reference to FIGS. 2-9 the fluid conduits within coiled tubing 104 are mutually configured to provide separate fluid transport until reaching a mixing applicator such as mixing applicator 114. A variety of multi-conduit transport and mixing applicator configuration may be utilized depending on the type of downhole treatment and other factors.

Figure 2A:
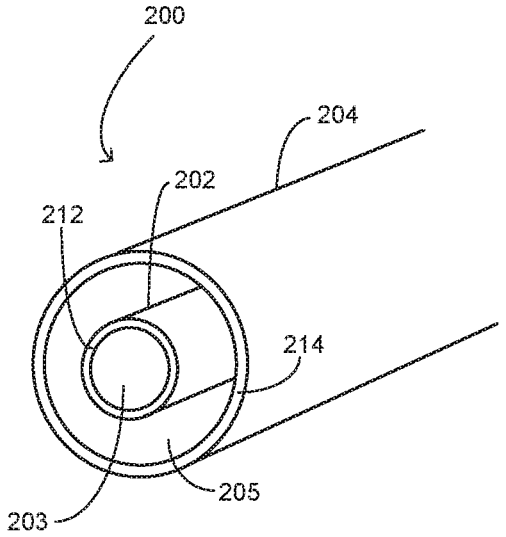
FIGS. 2A-2B illustrate a multi-fluid treatment delivery apparatus is accordance with some embodiments.
Figure 2B:
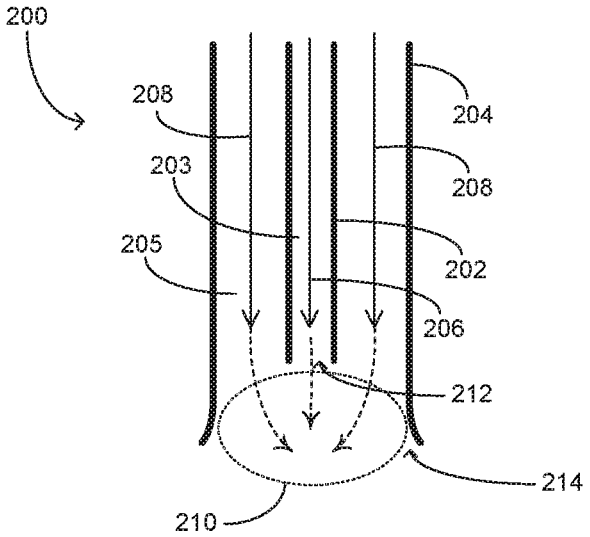

FIGS. 2A and 2B illustrate a fluid delivery apparatus 200 is accordance with some embodiments such as the embodiments depicted and described with reference to FIG. 1. Fluid delivery apparatus 200 includes components and features for separately transporting multiple fluids to and mixing the fluids at or proximate to a downhole treatment site. Deployed within a downhole treatment system, such as system 100, apparatus 200 may form a distal portion of coiled tubing 104 and/or all or a portion of mixing applicator 114. Apparatus 200 comprises a conduit 202 concentrically disposed within and coextensively aligned in parallel proximity with a conduit 204 that may form the outer layer of an injection string. A first enclosed channel 203 is formed within conduit 202 and a second enclosed channel 205 is formed between the outer surface of conduit 202 and the inner surface of conduit 204. In this configuration, conduit 202 and conduit 204 form a multi-conduit fluid transport component that may be formed from coiled tubing or straight segmented tubing. The multi-conduit configuration may be utilized to transport a first fluid 206 received at an inlet of conduit 202 and a second fluid 208 received at an inlet of second conduit 204. First fluid 206 and/or second fluid 208 may be loaded within the first and second conduits 202 and 204, respectively, prior to initiation of downhole mixing during a treatment operation. First fluid 206 and second fluid 208 are transported to a mixing applicator formed by or proximate to outlet 212 of conduit 202 and outlet 214 of conduit 204.

In the depicted embodiment, the mixing applicator may be formed, in part, by the relative positioning of outlets 212 and 214. As shown in FIG. 2B, outlet 212 is axially offset from outlet 214 within the enclosed channel 205 of conduit 204. In this manner, the mixing applicator is formed by outlets 212 and 214 and their relative positioning that forms a confluence region 210 in which fluid 206 is discharged. Within confluence region 210, discharged fluid 206 intersects with the flow path of fluid 208 within conduit 204 and at the discharge outlet 214.

Apparatus 200 may be installed as part of and/or on an injection tool string such as the injection string comprising coiled tubing 104 in FIG. 1. In such a configuration, the fluid provided by fluid source FC3 may be input to and pressurized by pump 138 into conduit 202, which forms an inner conduit within coiled tubing 104. An outer conduit of coiled tubing 104 that surrounds conduit 202 is formed by conduit 204 through which fluids from sources FC1 and/or FC2 are driven by pump 136. In this configuration, and when discharged concurrently, the fluid from source FC3 mixes with fluids from sources FC1 and/or FC2 within confluence region 210 proximate a downhole treatment site. The relative timing of fluid transport through conduits 202 and 204 via valves 130, 132, and 134, and pumps 136 and 138 may be controlled in accordance with a treatment schedule implemented by a control program such as injection control program 125 in FIG. 1. In addition to and/or in association with the relative timing of fluid transport, the injection control program may control the absolute and/or relative pumping pressures applied to the fluids during transport within the respective conduits 202 and 204.

Figure 3A:
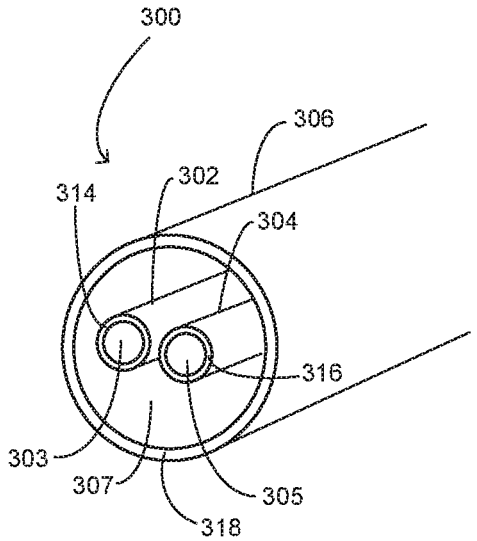
FIGS. 3A-3B depict a multi-fluid treatment delivery apparatus in accordance with some embodiments.
Figure 3B:
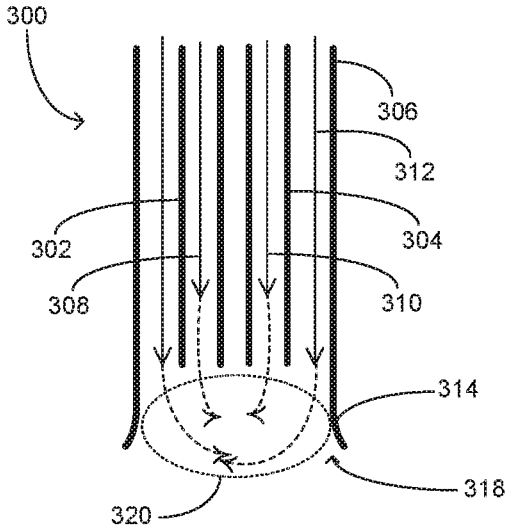

FIGS. 2A and 2B, as well as FIGS. 3A and 3B, depict the confluence region, such as confluence region 210, as being at least partially contained within conduit 204. Other embodiments may include a mixing applicator in which the conduit outlets, such as outlets 212 and 214, are substantially aligned such that the confluence region is formed primarily or completely outside all of the fluid transport conduits.

FIGS. 3A and 3B illustrate a fluid delivery apparatus 300 is accordance with some embodiments such as the embodiments depicted and described with reference to FIG. 1. Fluid delivery apparatus 300 includes components and features for transporting multiple fluids to and mixing the fluids at or proximate to a downhole treatment site. Deployed within a downhole treatment system, such as system 100, apparatus 300 may form a distal portion of coiled tubing 104 and/or all or a portion of mixing applicator 114. Apparatus 300 comprises a pair of conduits 302 and 304 that are co-extensively disposed within a conduit 306 that may form the outer layer of an injection string. A first enclosed channel 303 is formed within conduit 302, a second enclosed channel 305 is formed within conduit 304, and a third enclosed channel 307 is formed between the outer surfaces of conduits 302 and 304 and the inner surface of conduit 306.

In this configuration, conduits 302, 304, and 306 form a multi-conduit fluid transport component that may be formed from coiled tubing or segmented tubing. The multi-conduit configuration may be utilized to transport a first fluid 308 received at an inlet of conduit 302, a second fluid 310 received at an inlet of conduit 304, and a third fluid 312 received at an inlet of conduit 306 to a downhole mixing applicator. First fluid 308, second fluid 310, and third fluid 312 are transported through conduits 302, 304, and 306, respectively, to a mixing applicator formed by or proximate to outlets 314, 316, and 318.

In the depicted embodiment, the mixing applicator may be formed, in part, by the relative positioning of outlets 314, 316, and 318. As shown in FIG. 3B, outlets 314 and 316 are axially offset from outlet 318 within the enclosed channel 307 of conduit 306. In this manner, the mixing applicator is formed by outlets 314, 316, and 318 and their relative positioning that forms a confluence region 320 in which first and second fluids 308 and 310 are discharged sequentially or in partial or full concurrence with the discharge of third fluid 312 within confluence region 320. Within confluence region 320, discharged fluids 308 and 310 mutually intersect and intersect with the flow path of fluid 312 within conduit 306 and at the discharge outlet 318.

Apparatus 300 may be installed as part of and/or on an injection tool string such as the injection string comprising coiled tubing 104 in FIG. 1. In such a configuration, the fluid within fluid source FC3 may be input to and pressurized by pump 138 into conduit 306, which forms an outer conduit of coiled tubing 104. Inner conduits of coiled tubing 104 within conduit 306 are formed by conduits 302 and 304 through which fluids from sources FC1 and/or FC2 are input and driven by valves 130 and 132 and pump 136. In this configuration, and when discharged concurrently, the fluid from source FC3 mixes with fluids from sources FC1 and/or FC2 within confluence region 320 proximate a downhole treatment site. As with apparatus 200 and any other multi-conduit configuration, the relative timing of fluid transport through conduits 302, 304, and 306 via valves 130, 132, and 134, and pumps 136 and 138 may be controlled in accordance with a treatment schedule implemented by a control program such as injection control program 125. In addition to and/or in association with the relative timing of fluid transport, the injection control program may control the absolute and/or relative pumping pressures applied to the fluids during transport within the respective conduits 302, 304, and 306.

Figure 4:
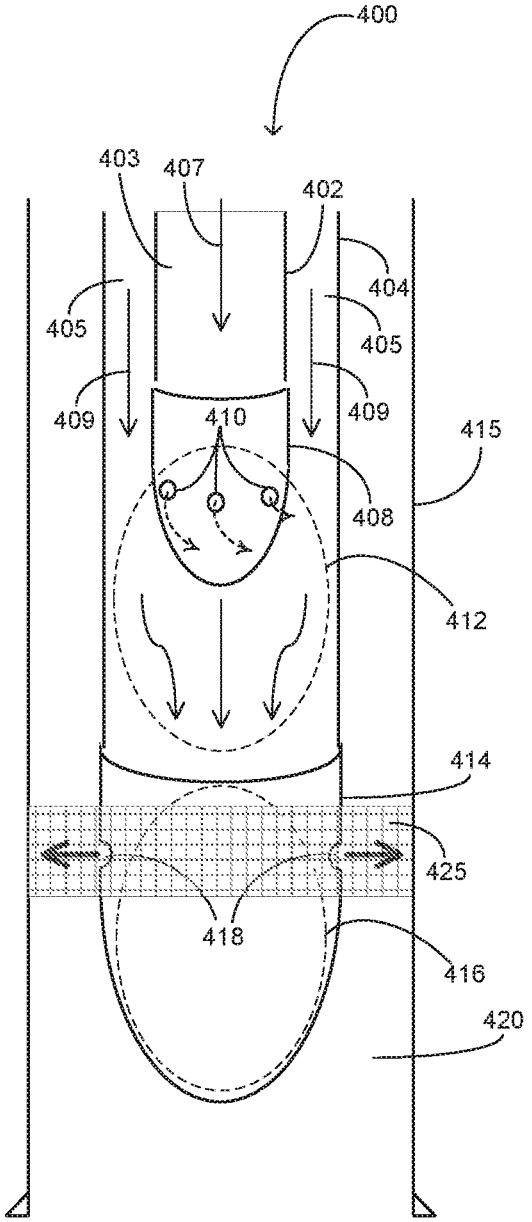
FIG. 4 illustrates a treatment apparatus having a mixing applicator comprising dual internal mixing subs in accordance with some embodiments.

FIG. 4 illustrates a treatment apparatus 400 having a mixing applicator comprising dual internal mixing subs in accordance with some embodiments. As with the apparatuses depicted in FIGS. 2 and 3, treatment apparatus 400 includes fluid delivery components for transporting and mixing multiple fluid flows as well as mixture discharge components for applying the mixture at or proximate to a treatment site. Deployed within a downhole treatment system, such as system 100 in FIG. 1, treatment apparatus 400 may form a distal portion of coiled tubing 104 and/or all or a portion of mixing applicator 114. Treatment apparatus 400 comprises an inner conduit 402 concentrically disposed within and coextensively aligned in parallel proximity with an outer conduit 404 that may form the outer layer of a coiled tubing injection string. A first enclosed channel 403 is formed within conduit 402 and a second enclosed channel 405 is formed between the outer surface of conduit 402 and the inner surface of conduit 404. In this configuration, conduits 402 and 404 form a multi-conduit fluid transport component that may be formed from coiled tubing or straight segmented tubing. The multi-conduit configuration may be utilized to transport a first fluid 407 received at an inlet of conduit 402 and a second fluid 409 received at an inlet of second conduit 404. First fluid 407 and second fluid 409 are transported to a mixing applicator formed by a two-stage internal mixing sub comprising an inner mixing sub 408 and an outer mixing sub 414.

In the depicted embodiment, the mixing applicator may be formed, in part, by the individual and relative configuration of inner and outer mixing subs 408 and 414. The mixing applicator includes mixing subs 408 and 411 that are each configured, in part, as rounded conduit termination caps that form the distal ends of each of conduits 402 and 404, respectively. Inner mixing sub 408 includes orifices 410 that collectively form a distributed and dispersed flow path for fluid 407 from channel 403 into channel 405. Orifices 410 are each substantially smaller in surface area, such as smaller in diameter, than the flow area of channel 403. Configured in this manner, each of orifices 410 within the rounded and otherwise substantially enclosed mixing sub 408 forms an effective nozzle component through which fluid 407 is accelerated that collectively induces radial and/or cyclonic flow into confluence region 412. Mixing sub 408 is axially offset from mixing sub 414 within the enclosed channel 405 of conduit 404. As depicted, the discharge path formed by orifices 410 is configured to discharge fluid 407 into a first confluence region 412 in which fluid 407 intersects with the flow of fluid 409 within channel 405. The mixing applicator therefore comprises mixing sub 408 that is contained within conduit 404 and is axially offset from outer mixing sub 414 to form first confluence region 412 in which fluids 407 and 409 are initially mixed utilizing the enhanced turbulent nozzle flow provided by orifices 410.

Outer mixing sub 414 of the depicted mixing applicator is configured to perform a secondary mixing function as well as a mixture discharge function. Outer mixing sub 414 is configured as a fluidic oscillator comprising a rounded end cap that is substantially enclosed at a lower portion in which a second secondary mixture zone 416 is formed. Within mixture zone 416, fluids 407 and 409 continue to mix within the delivery fluid forced applied from channel 405 and orifices 410. Outer mixing sub 414 includes orifices 418 that as depicted are positioned downstream of orifices 410 and above a lowermost end of mixing sub 414 and collectively provide a discharge outlet for the mixture of fluids 407 and 409. Apparatus 400 is position downhole, such as by a coiled tubing injection system, such that orifices 418 are position at or proximate to a treatment site 425 within wellbore 420. Orifices 418 may individually and collectively form a smaller flow path than the flow path of channel 405 such that the backpressure within mixing sub 414 enhances mixture of fluids 407 and 409 within secondary mixing zone 416.

Apparatus 400 may be installed as part of and/or on an injection tool string such as the injection string comprising coiled tubing 104 in FIG. 1. In such a configuration, the fluid provided by fluid source FC3 may be input to and pressurized by pump 138 into conduit 402, which forms an inner conduit within coiled tubing 104. An outer conduit of coiled tubing 104 that surrounds conduit 402 is formed by conduit 404 through which fluids from sources FC1 and/or FC2 are driven by pump 136. In this configuration, and when discharged concurrently, the fluid from source FC3 mixes with fluids from sources FC1 and/or FC2 within confluence region 416 and secondary mixing zone 416. The mixed fluid components are discharged through orifices 418 at or proximate downhole treatment site 425. The relative timing of fluid transport through conduits 402 and 404 via valves 130, 132, and 134, and pumps 136 and 138 may be controlled in accordance with a treatment schedule implemented by a control program such as injection control program 125 in FIG. 1. In addition to and/or in association with the relative timing of fluid transport, the injection control program may control the absolute and/or relative pumping pressures applied to the fluids during transport within the respective conduits 402 and 404.

Regarding the various embodiments depicted in FIGS. 1-4 as well as FIGS. 5-9, it should be noted that some or all of the flow control signal input may be provided in alternative manners based on alternative input. The activation, switching, and other operational control of one or more of the flow control devices such as valves 130, 132, and 134, and pumps 136 and 138 may be implemented in a non-programmed and decentralized manner and/or without use of downhole sensor information. For example, flow control signals may be generated by manual activation of pump and valve actuation components based, at least in part, on surface sensor information.

Figure 5:
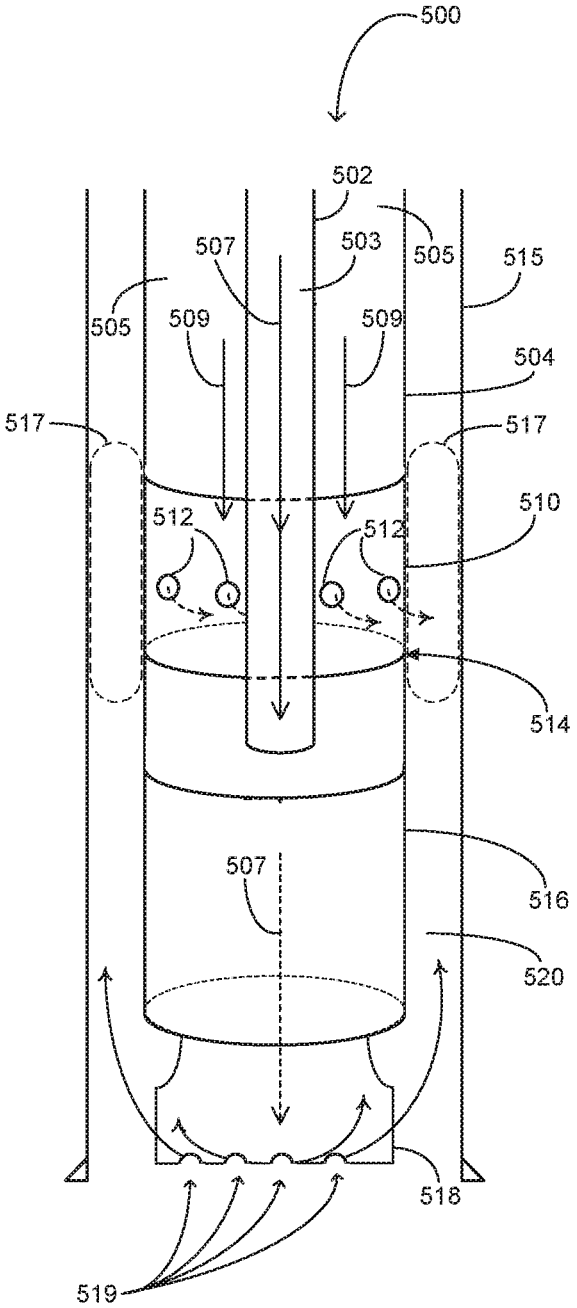
FIG. 5 depicts a treatment apparatus having a mixing applicator comprising an external mixing sub in accordance with some embodiments.

FIG. 5 depicts a treatment apparatus 500 having a mixing applicator configured in part as an external mixing sub in accordance with some embodiments. As with the apparatuses depicted in FIGS. 2, 3, and 4 treatment apparatus 500 includes fluid delivery components for transporting and mixing multiple fluid flows as well as mixture discharge components for applying the mixture at or proximate to a treatment site. Deployed within a downhole treatment system, such as system 100 in FIG. 1, treatment apparatus 500 may form a distal portion of coiled tubing 104 and/or all or a portion of mixing applicator 114. Treatment apparatus 500 comprises an inner conduit 502 concentrically disposed within and coextensively aligned in parallel proximity with an outer conduit 504 that may form the outer layer of a coiled tubing injection string. A first enclosed channel 503 is formed within conduit 502 and a second enclosed channel 505 is formed between the outer surface of conduit 502 and the inner surface of conduit 504. In this configuration, conduits 502 and 504 form a multi-conduit fluid transport component that may be formed from coiled tubing or straight segmented tubing.

The multi-conduit configuration may be utilized to transport a first fluid 507 received at an inlet of conduit 502 and a second fluid 509 received at an inlet of second conduit 504. First fluid 507 and second fluid 509 are transported to a mixing applicator that is incorporated in a milling tool that includes cutting components and debris removal components. The milling tool includes an external mixing sub 510 and a mud motor 516 that drives a cutting tool 518 for cutting material from structures on or within casing 515 and/or otherwise within wellbore 520. In combination, the components of the milling tool are configured to cut/grind material within wellbore 520 and remove the resultant debris. In some embodiments, fluid 507 flows through inner conduit 502 and into mud motor 516 to power mud motor 516 to drive cutting tool 518. Fluid 507 further flows into and through cutting tool 518 via discharge orifices 519 to form an upward flow pressure within wellbore 520. Flowing downward through cutting tool 518 may provide lubrication and cooling for cutting tool 518 during operation. Flowing upward into wellbore 520 from orifices 519, fluid 507 provides a debris transport medium to transport the debris uphole.

In some embodiments, fluid 509 may also be utilized to facilitate milling operations such as by serving as a liquid or gaseous solvent that may or may not interact with fluid 507 to perform a milling function such as removing and/or dissolving debris, sealing portions of formation wall exposed by the cutting, etc. Apparatus 500 is configured to discharge fluid 509 at a relative position within the overall milling tool such that exposure of lower milling tool components including mud motor 516 to fluid 509 is reduced or prevented. External mixing sub 510 includes structural features and components configured to direct the flow of the fluid 509 within the outer conduit 504 to exit the milling tool assembly prior to passing through the lower components including mud motor 516 and cutting tool 518. External mixing sub 510 includes a lower annular surface 514 through which conduit 502 passes but that substantially seals channel 505 of conduit 504. External mixing sub 510 further includes a set of one or more orifices 512 disposed above lower surface 514 and that provide a flow path from channel 505 into wellbore 520. A confluence region in formed 517 in which the upward flow of fluid 507 intersects the discharge flow of fluid 509 from orifices 512 to enable mixing for embodiments in which fluids 507 and 509 are intended to be mixed in furtherance of the milling procedure.

As depicted and described with reference to FIGS. 1-5, the treatment systems and apparatus may include various fluid transport, mixing, and discharge outlet configurations. The treatment systems and apparatuses may further include various downhole fluid flow isolation components that provide a controlled valve function that may be utilized in combination with the pump and surface valve control of fluid flows and flow rates to implement a multi-fluid downhole treatment. FIGS. 6-9 depict mixing applicators that integrate valving components such as may be incorporated into one or more of the mixing applicator assemblies depicted and described with reference to FIGS. 1-5.

Figure 6A:
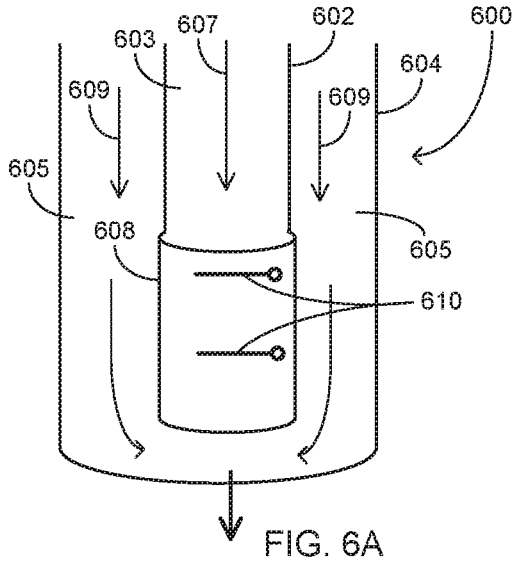
FIGS. 6A-6B illustrate a mixing applicator that includes a flapper type valve configured to control downhole mixture timing and treatment application in accordance with some embodiments.
Figure 6B:
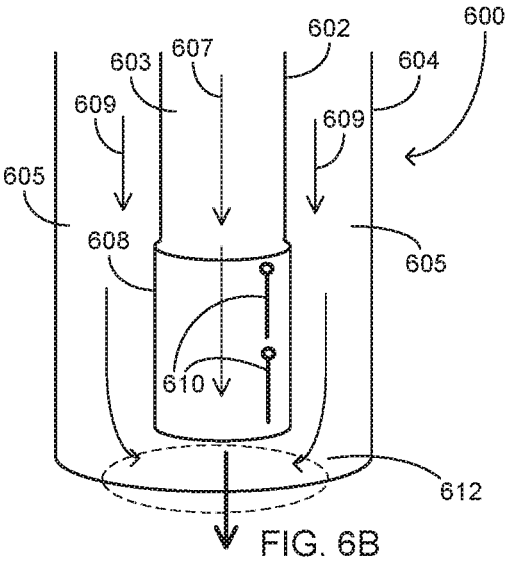

FIGS. 6A-6B illustrate a mixing applicator 600 that includes a flapper type valve configured to control downhole mixture timing and treatment application in accordance with some embodiments. Mixing applicator 600 includes components and features for mixing multiple separately transported fluids at or proximate to a downhole treatment site. Mixing applicator 600 comprises an inner conduit 602 concentrically disposed within and coextensively aligned in parallel proximity with an outer conduit 604 that may form the outer layer of an injection string. A first enclosed channel 603 is formed within conduit 602 and a second enclosed channel 605 is formed between the outer surface of conduit 602 and the inner surface of conduit 604. In this configuration, conduits 602 and 604 form a multi-conduit fluid transport component that may be formed from coiled tubing or straight segmented tubing. The multi-conduit configuration may be utilized to transport a first fluid 607 through conduit 602 and a second fluid 609 through outer conduit 604.

Mixing applicator 600 further includes a pressure-sensitive flapper valve 608 that terminates conduit 602. Flapper valve 608 comprises a flow path in which flappers 610 are positioned as depicted in FIG. 6A to stop the flow of fluid 607. Flappers 610 include pressure-sensitive hinges that maintain a stop flow position until pressure applied by fluid 607 reaches a specified threshold pressure. Once the specified threshold pressure of fluid 607 within conduit 602 is met or exceeded, flappers 610 change position as shown in FIG. 6B to an open position. Once flappers 610 are in the open position, fluid 607 flows through flapper valve 608 and into a confluence region 612 in which is intersects and mixes with fluid 609. Depending on the discharge configuration, such as depicted in FIGS. 2-5, the mixture is discharged at or proximate to a treatment site.

Figure 7A:
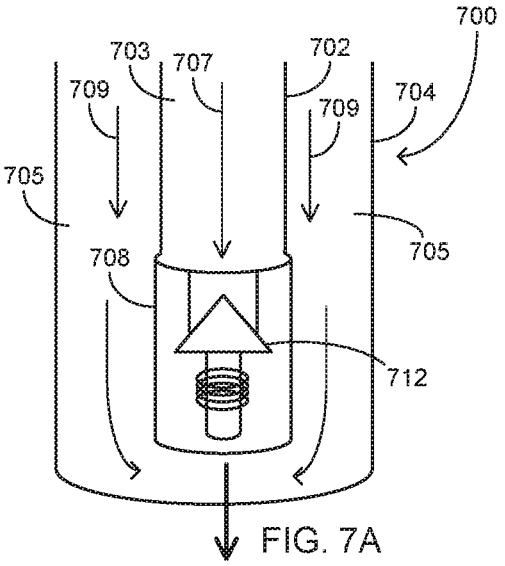
FIGS. 7A-7B depict a mixing applicator that includes a spring type valve configured to control downhole mixture timing and treatment application in accordance with some embodiments.
Figure 7B:
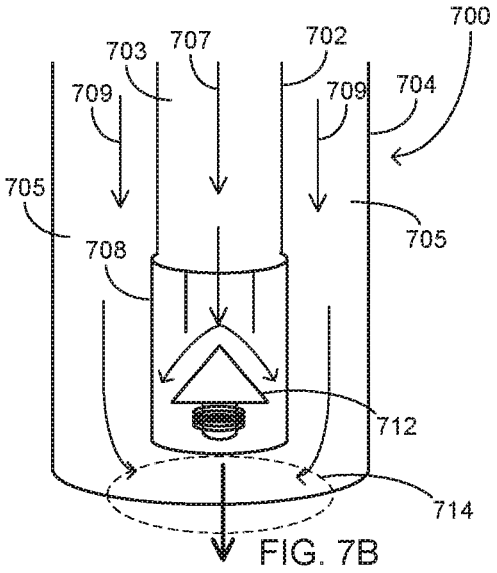

FIGS. 7A-7B depict a mixing applicator 700 that includes a spring type valve configured to control downhole mixture timing and treatment application in accordance with some embodiments. Mixing applicator 700 includes components and features for mixing multiple separately transported fluids at or proximate to a downhole treatment site. Mixing applicator 700 comprises an inner conduit 702 concentrically disposed within and coextensively aligned in parallel proximity with an outer conduit 704 that may form the outer layer of an injection string. A first enclosed channel 703 is formed within conduit 702 and a second enclosed channel 705 is formed between the outer surface of conduit 702 and the inner surface of conduit 704. In this configuration, conduits 702 and 704 form a multi-conduit fluid transport component that may be formed from coiled tubing or straight segmented tubing. The multi-conduit configuration may be utilized to transport a first fluid 707 through conduit 702 and a second fluid 709 through outer conduit 704.

Mixing applicator 700 further includes a pressure-sensitive spring valve 708 that terminates conduit 702. Spring valve 708 comprises a flow path in which spring stopper 712 is positioned as depicted in FIG. 7A to stop the flow of fluid 707. Spring stopper 712 is pressure-sensitive to maintain a stop flow position until a pressure applied by fluid 707 reaches a specified threshold pressure. Once the specified threshold pressure applied by fluid 707 is met or exceeded, spring stopper 712 changes position as shown in FIG. 7B to an open position. With spring stopper 712 in the open position, fluid 707 flows through spring valve 708 and into a confluence region 714 in which is intersects and mixes with fluid 709. Depending on the discharge configuration, such as depicted in FIGS. 2-5, the mixture is discharged at or proximate to a treatment site.

Figure 8A:
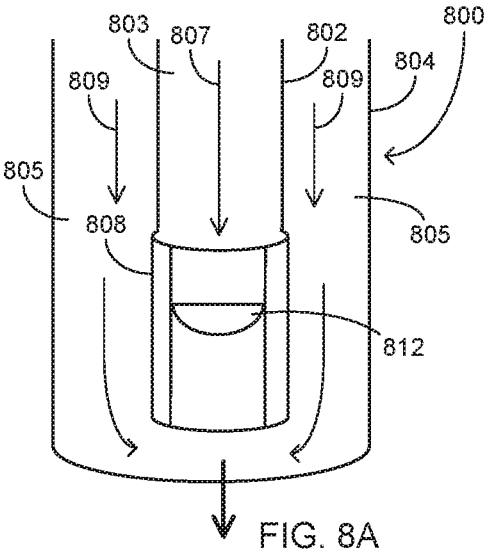
FIGS. 8A-8B illustrate a mixing applicator that includes a rupture disk flow control component configured to control downhole mixture timing and treatment application in accordance with some embodiments.
Figure 8B:
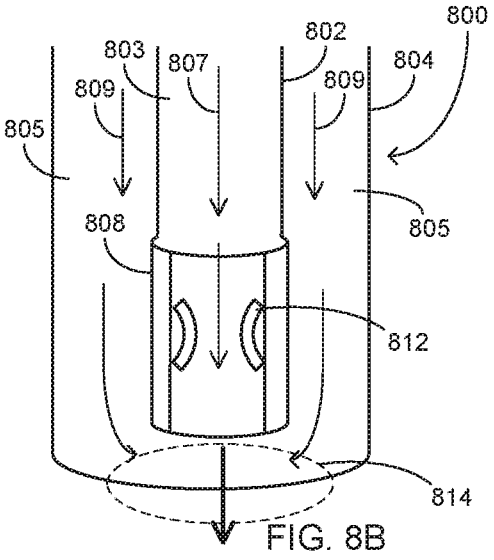

FIGS. 8A-8B illustrate a mixing applicator 800 that includes a rupture disk flow control component configured to control downhole mixture timing and treatment application in accordance with some embodiments. Mixing applicator 800 includes components and features for mixing multiple separately transported fluids at or proximate to a downhole treatment site. Mixing applicator 800 comprises an inner conduit 802 concentrically disposed within and coextensively aligned in parallel proximity with an outer conduit 804 that may form the outer layer of an injection string. A first enclosed channel 803 is formed within conduit 802 and a second enclosed channel 805 is formed between the outer surface of conduit 802 and the inner surface of conduit 804. In this configuration, conduits 802 and 804 form a multi-conduit fluid transport component that may be formed from coiled tubing or straight segmented tubing. The multi-conduit configuration may be utilized to transport a first fluid 807 through conduit 802 and a second fluid 809 through outer conduit 804.

Mixing applicator 800 further includes a pressure-sensitive rupture disk valve 808 that terminates conduit 802. Rupture disk valve 808 comprises a flow path in which a frangible disk 812 is positioned as depicted in FIG. 8A to stop the flow of fluid 807. Frangible disk 812 is pressure-sensitive to maintain a stop flow position until a pressure applied by fluid 807 reaches a specified threshold pressure. Once the specified pressed applied by fluid 807 is met or exceeded, frangible disk 812 breaches as shown in FIG. 8B and provides an open flow path. With frangible disk 812 in the open position, fluid 807 flows through rupture disk valve 808 and into a confluence region 814 in which fluid 807 intersects and mixes with fluid 809. Depending on the discharge configuration, such as depicted in FIGS. 2-5, the mixture is discharged at or proximate to a treatment site.

Figure 9A:
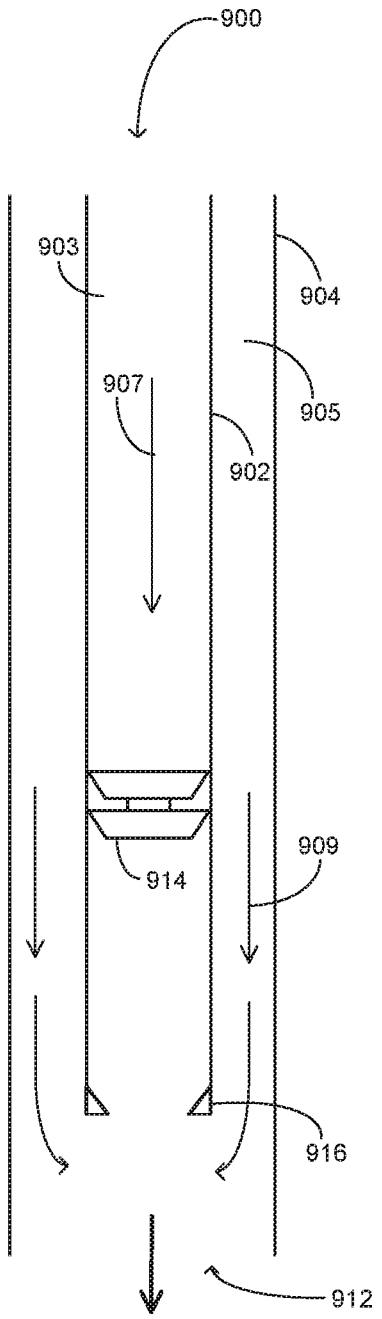
FIGS. 9A-9C depict a mixing applicator that includes serially deployed fluid containment plugs configured to sequentially control fluid component mixing in accordance with some embodiments.
Figure 9B:
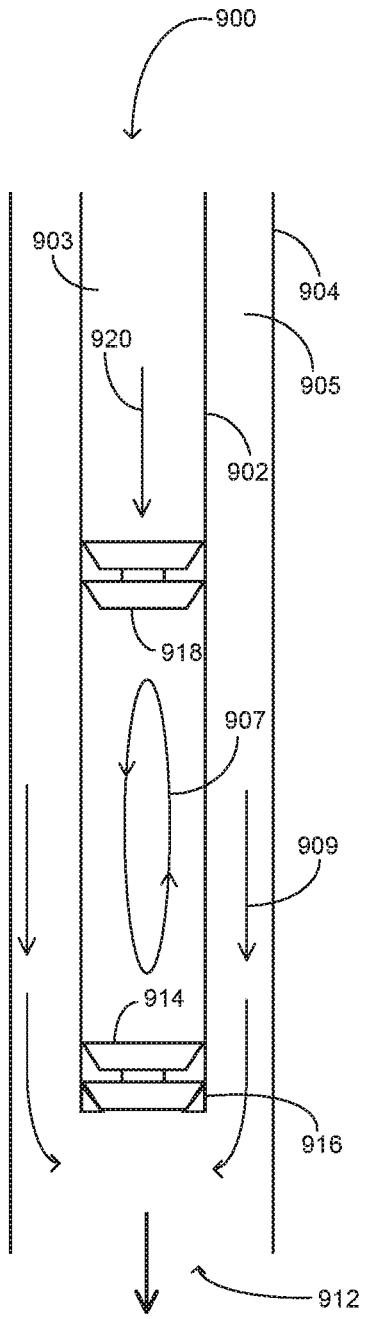
Figure 9C:
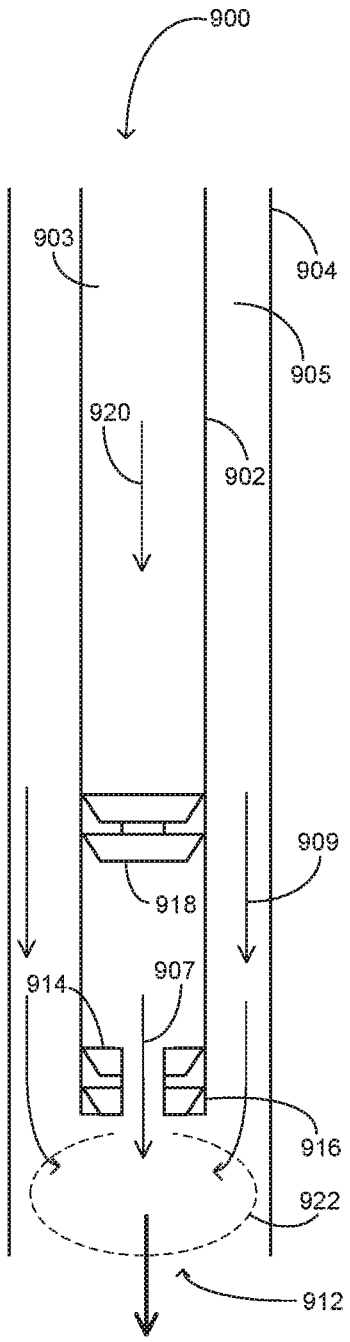

FIGS. 9A-9C depict a mixing applicator 900 that includes serially deployed fluid containment plugs configured to sequentially control fluid component mixing in accordance with some embodiments. Mixing applicator 900 includes components and features for mixing multiple separately transported fluids at or proximate to a downhole treatment site. Mixing applicator 900 comprises an inner conduit 902 concentrically disposed within and coextensively aligned in parallel proximity with an outer conduit 904 that may form the outer layer of an injection string. A first enclosed channel 903 is formed within conduit 902 and a second enclosed channel 905 is formed between the outer surface of conduit 902 and the inner surface of conduit 904. In this configuration, conduits 902 and 904 form a multi-conduit fluid transport component that may be formed from coiled tubing or straight segmented tubing. The multi-conduit configuration may be utilized to transport a series of one or more fluids through conduit 902 and a second fluid 909 through outer conduit 904.

Mixing applicator 900 further comprises a fluid containment plug assembly including a plug seat 916 that terminates conduit 902 and a series of one or more dart plugs such as plugs 914 and 918. Plug seat 916 is formed as an internally annular flange or otherwise to forms an annular seating surface into which a series of one or more dart plugs such as the depicted dart plugs 914 and 918 may be seated during sequential phases of a multi-fluid downhole treatment. FIG. 9A illustrates a configuration of mixing applicator 900 during a first depicted phase of a downhole treatment. During the first phase, fluid 909 flows through channel 905 to an outlet 912 of conduit 904 and a fluid 907 flows through channel 903, driving dart plug 914 toward plug seat 916.

As shown in FIG. 9B, the volume of fluid 907 is contained within conduit 902 behind dart plug 914 when dart plug 914 seats at a second phase. During or following transports of the volume of fluid 907 and dart plug 914, a volume of a second fluid 920 is input and flows through conduit 902 behind a second dart plug 918. Dart plugs 914 and 918 are configured as frangible plugs that stop flow when seated or otherwise unbreached within conduit 902. Dart plugs 914 and 918 are configured breach to allow flow through at respectively design breach pressures. For example, a lead plug such as dart plug 914 may be designed with a breach pressure that is lower than the breach pressure of following plug such as plug 918. During the second phase depicted in FIG. 9B, the volume of fluid 907 is contained within conduit 902 between seated dart plug 914 and dart plug 918, and the volume of fluid 920 is concurrently contained behind dart plug 918. A series of control signals may be transmitted to pumps (depicted and described with reference to FIG. 1) that apply fluid pressure to the fluid column that includes the volumes of fluids 907 and 909, or for systems without a control program 125 or downhole sensors 116/command module 117, the fluid pressure may be applied manually at any time after a specified fluid volume has been pumped or surface pressure indication is observed, to ensure dart plugs 914 and 918 have reached the end of tubing.

Once the specified pressed applied to the fluid column reaches a design breach point at a third phase, dart plug 914 breaches as shown in FIG. 9C and provides an open flow path. During the third phase, fluid 907 flows through ruptured dart plug 914 and into a confluence region 922 in which fluid 907 intersects and mixes with fluid 809. Depending on the discharge configuration, such as depicted in FIGS. 2-5, the mixture is discharged at or proximate to a treatment site. Following discharge of fluid 907, dart plug 918 seats in plug seat 916 to temporarily contain the volume of fluid 920 within conduit 902 pending a subsequent mixture phase. Subsequent phases may be performed, for instance, in which pump pressure control is applied to breach dart plug 918 to permit fluid 920 to intermix with fluid 909 within confluence region 922.

Figure 10:
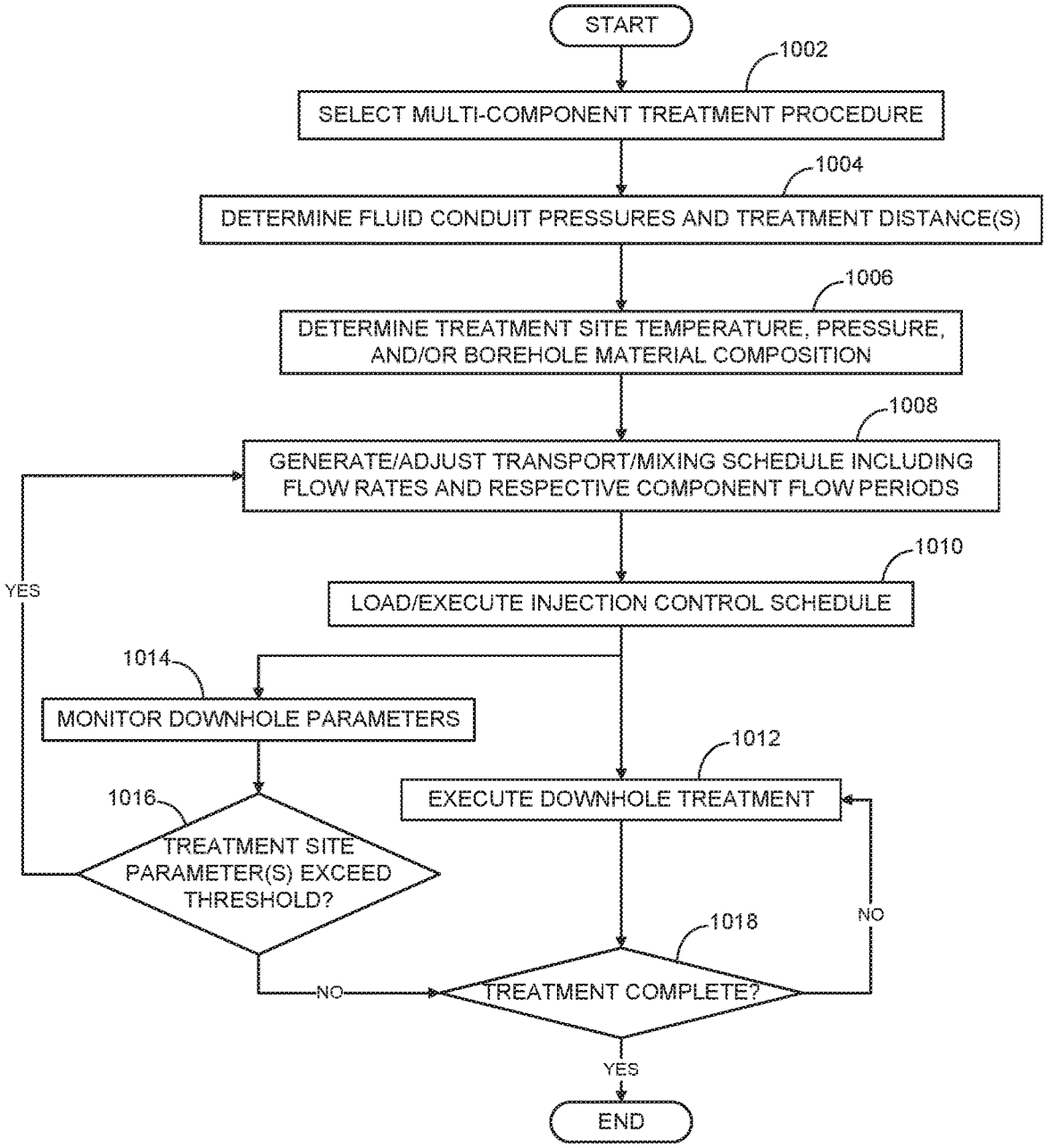
FIG. 10 is a flow diagram illustrating operations and functions for applying a multicomponent fluid treatment in accordance with some embodiments.

FIG. 10 is a flow diagram illustrating operations and functions for applying a multicomponent fluid treatment in accordance with some embodiments. The operations and functions in FIG. 10 may be performed by systems, subsystems, devices, and components depicted and described in FIGS. 1-9 and 11. For example, injection control system 125 in FIG. 1 may be configured to perform one or more of the operations and functions depicted and/or described with reference to FIG. 10. The process begins as shown at block 1002 with an injection scheduler component, such as treatment adapter 126, selecting a multi-component treatment procedure. In some embodiments, the selection encompasses accessing a treatment procedure database in response to a request submitted via a user interface. Each of the selectable treatment procedures comprises information specifying the fluid components, mixtures including relative concentrations of respective components in the mixtures, and component and mixture volumes required for a respective downhole treatment.

As shown at block 1004, a data processing system in combination with injection string control components and downhole sensors determine treatment operation parameters such as transport distances for each of the respective separately transported fluids. The determination at block 1004 may further include determining downhole environment parameters such as fluid pressure(s) within the fluid conduits. At block 1006, the data processing system in conjunction with downhole sensors such as downhole sensors 116 determine treatment site environment information such as downhole temperature, pressure, and treatment site material composition.

As shown at block 1008, a scheduling component of the injection controller, such as scheduler 128, generates one or more fluid component transport and mixing schedules based the selected treatment procedure and on the fluid conduit pressures and lengths (transport distances) and on treatment site environment parameters determined at blocks 1004 and 1006. In some embodiments, in which downhole valving control components such as those depicted in FIGS. 6-9 are utilized, the transport and mixing schedules are generated further based on the individual and collective flow control configurations of each of the individual fluid conduits. Each of the one or more generated transport and mixing schedules comprises instructions and data for actuating and otherwise operating flow control devices that control the timing and values of flows, flow rates, and pressures within each of the fluid conduits. The flow control devices may include one or more fluid pumps and valves such as pumps 136 and 138 and valves 130, 132, and 134 in FIG. 1.

As shown at block 1010, the data processing system loads and executes the one or more transport and mixing schedules generated at block 1008. For instance, the data processing system may execute transport and mixing schedule instructions that transmit a series of flow control signals to the flow control devices. At block 1012, implementation of the downhole treatment is effectuated in accordance with the actuation and other operational control of the flow control devices in accordance with the transport and mixing schedule. Namely, the control signals transmitted to the flow control devices and relative timing thereof actuate and otherwise operate the devices in the manner and in the sequentially offset timing implemented by the transport and mixing schedule. During implementation of the downhole treatment including execution of the transport and mixing schedule(s), the data processing system in conjunction with downhole sensors monitors downhole operational and/or environment parameters (block 1014). As shown at flow control block 1016, the injection control component is further configured to adjust the generated transport and mixing schedule(s) in response to determining that one or more downhole parameters has exceeded a threshold. If, as determined at block 1016, a downhole parameter such as downhole temperature and/or fluid conduit pressure exceed a specified threshold value, control returns to block 1008. At block 1008, the previously generated fluid transport and mixing schedule is adjusted based on the downhole parameter value that exceeds the threshold and the execution sequence recommences at blocks 1010 and 1012. The downhole treatment execution with downhole parameter monitoring control continues until the treatment is completed as determined at sequence control block 1018.

Example Computer

Figure 11:
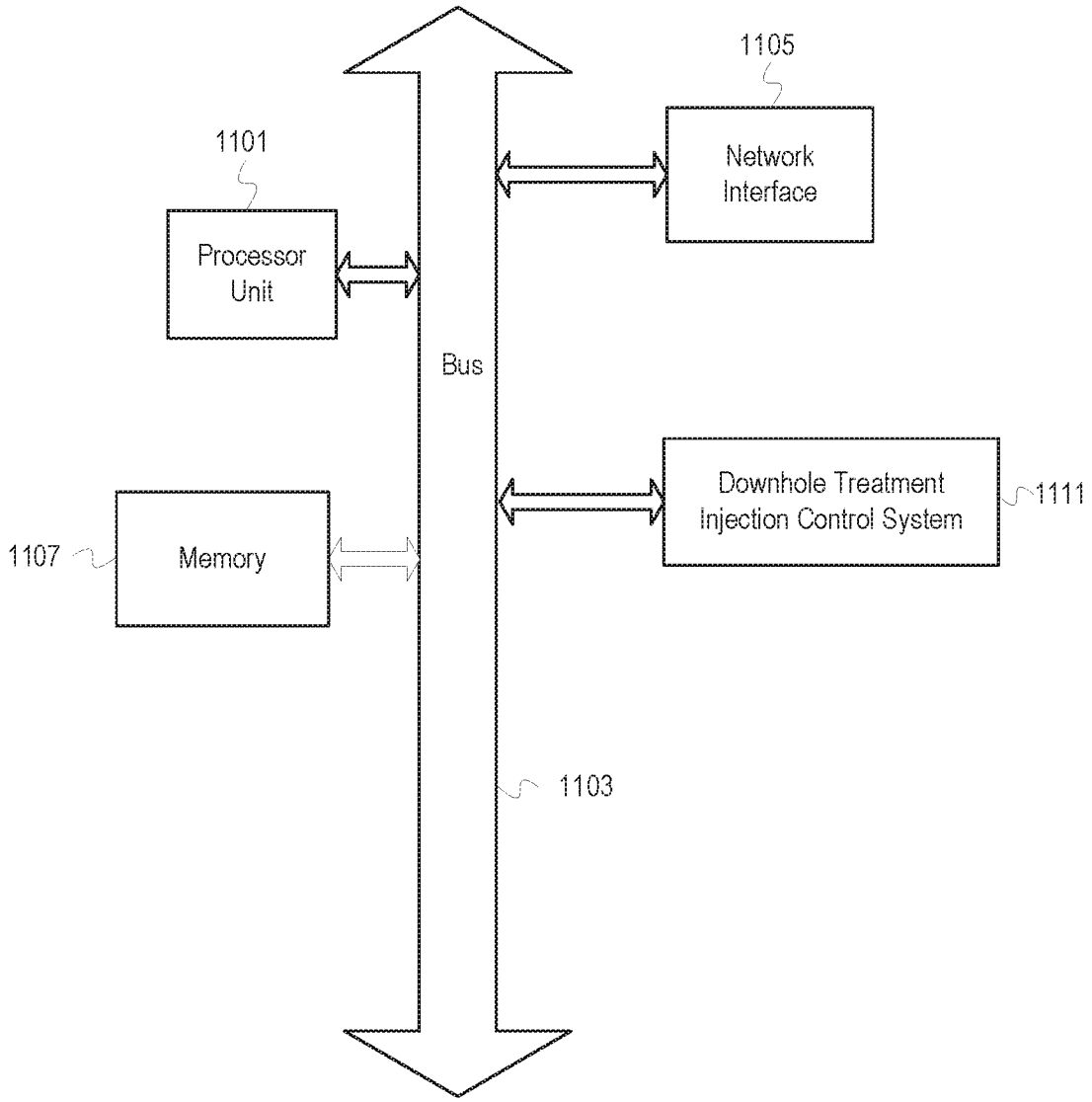
FIG. 11 is a block diagram depicting an example computer system that may be utilized to implement multi-component downhole treatment delivery in accordance with some embodiments.

FIG. 11 is a block diagram depicting an example computer system that may be utilized to implement control operations for implementing a multi-component downhole treatment operation in accordance with some embodiments. The computer system includes a processor 1101 (possibly including multiple processors, multiple cores, multiple nodes, and/or implementing multi-threading, etc.). The computer system includes a memory 1107. The memory 1107 may be system memory (e.g., one or more of cache, SRAM, DRAM, etc.) or any one or more of the above already described possible realizations of machine-readable media. The computer system also includes a bus 1103 (e.g., PCI, ISA, PCI-Express, InfiniBand® bus, NuBus, etc.) and a network interface 1105 which may comprise a Fiber Channel, Ethernet interface, SONET, or other interface.

The system also includes an injection control system 1111, which may comprise hardware, software, firmware, or a combination thereof. Injection control system 1111 may be configured similarly to injection control system 125 in FIG. 1. For example, injection control system 1111 may comprise instructions executable by the processor 1101. Any one of the previously described functionalities may be partially (or entirely) implemented in hardware and/or on the processor 1101. For example, the functionality may be implemented with an application specific integrated circuit, in logic implemented in the processor 1101, in a co-processor on a peripheral device or card, etc. Injection control system 1111 generates multi-component fluid flow control signals that may be transmitted to flow control devices such as pumps and valves in the manner described above. Additional realizations may include fewer or more components not expressly illustrated in FIG. 11 (e.g., video cards, audio cards, additional network interfaces, peripheral devices, etc.).

Variations

While the aspects of the disclosure are described with reference to various implementations and exploitations, it will be understood that these aspects are illustrative and that the scope of the claims is not limited to them. In general, techniques for applying multi-component downhole treatments as described herein may be implemented with facilities consistent with any hardware system or systems. Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The machine readable medium may be a machine readable signal medium or a machine readable storage medium. A machine readable storage medium may be, for example, but not limited to, a system, apparatus, or device, that employs any one of or combination of electronic, magnetic, optical, electromagnetic, infrared, or semiconductor technology to store program code.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine. The program code/instructions may also be stored in a machine readable medium that can direct a machine to function in a particular manner, such that the instructions stored in the machine readable medium produce an article of manufacture including instructions which implement the function/act specified in the flowchart and/or block diagram block or blocks.

Use of the phrase "at least one of" preceding a list with the conjunction "and" should not be treated as an exclusive list and should not be construed as a list of categories with one item from each category, unless specifically stated otherwise.

EMBODIMENTS

Embodiment 1

An apparatus comprising: a first conduit configured to transport a first fluid from a first fluid source through a first enclosed channel to a first outlet; a second conduit configured to transport a second fluid from a second fluid source through a second enclosed channel to a second outlet; and a mixing applicator that includes the first outlet positioned to provide a discharge path for the first fluid that at least partially intersects a flow path of the second fluid within a confluence region within or external to the second conduit. For Embodiment 1, the apparatus may include a coiled tubing tool string within which the second conduit is coextensively disposed in substantially parallel proximity with respect to the first conduit. For Embodiment 1, the first conduit may be coextensively disposed within the second conduit.

Embodiment 2

The apparatus of Embodiment 1, wherein the mixing applicator comprises an internal mixing sub in which the first outlet comprises one or more orifices in the first conduit and the second outlet comprises one or more orifices in the second conduit downstream of the one or more orifices in the first conduit. For Embodiment 2, each of the one or more orifices in the first conduit may have a smaller surface area than a flow area through the first conduit. For Embodiments 1-2, the mixing applicator may include a pressure-sensitive flow control component that blocks flow to the first outlet when fluid pressure within the first conduit is below a threshold pressure. For Embodiments 1-2, the mixing applicator may be included in a treatment tool on a tool string and is configured to discharge combined fluid components from the confluence region to a region external to the treatment tool.

Embodiment 3

The apparatus of Embodiments 1-2, further comprising: at least one flow control device that is configured to control flow of the first fluid through the first conduit and to control flow of the second fluid through the second conduit; and a flow control system configured to operate said at least one flow control device based, at least in part, on a downhole parameter and a treatment procedure. For Embodiment 3, the at least one flow control device may comprise: a first pump having an input port that receives the first fluid and an output port coupled to an inlet of the first conduit; and a second pump having an input port that receives the second fluid and an output port coupled to an inlet of the second conduit.

Embodiment 4

A method comprising: transporting a first fluid through a first conduit to a first outlet; transporting a second fluid through a second conduit to a second outlet; and combining the first and second fluids within a confluence region that includes at least a portion of a discharge flow path from the first outlet. For Embodiment 4, wherein the first conduit and the second conduit may be included in an injection string having a mixing applicator that includes the first outlet and the second outlet. For Embodiment 4, the first and second fluids may be loaded within the first and second conduits prior to initiation of downhole mixing during a treatment operation. For Embodiment 4, said transporting the first and second fluids may comprise: transporting a volume of the first fluid based on a treatment procedure; and transporting a volume of the second fluid based on the treatment procedure. For Embodiment 4, said transporting the volume of the first fluid may comprise pumping the first fluid at a first rate, and wherein said transporting the volume of the second fluid comprises pumping the second fluid at a second rate determined based, at least in part, on the first rate. For Embodiment 4, said combining the first and second fluids may include discharging the first fluid from the first outlet that is disposed in the confluence region within or external to the second conduit. For Embodiment 4, said transporting a volume of the first fluid and transporting a volume of the second fluid may comprise: in response to a treatment request, selecting the treatment procedure that indicates mixing parameters of the first fluid and the second fluid; determining at least one downhole parameter; and generating a transport and mixing schedule based, at least in part, on the treatment procedure and the at least one downhole parameter. For Embodiment 4, the mixing parameters may include a reaction period associated with at least one environmental parameter. For Embodiment 4, the downhole parameter may be at least one of a fluid pressure of the first conduit, a fluid pressure of the second conduit, and a downhole temperature. For Embodiment 4, said transporting the volume of the second fluid based on the treatment procedure may comprise initiating or terminating transport of the second fluid relative to initiating or terminating transport of the first fluid based, at least in part, on the transport and mixing schedule. For Embodiment 4, the method further comprises mixing the first and second fluids at a point during a treatment operation based on the transport and mixing schedule.

What is claimed is:

1. A downhole treatment apparatus comprising:

a first conduit configured to transport a first fluid from a first fluid source at a surface of a wellbore through a first enclosed channel to a first outlet positioned in the wellbore;

a second conduit configured to transport a second fluid from a second fluid source at the surface of the wellbore through a second enclosed channel to a second outlet positioned in the wellbore;

a data processing system comprising a treatment procedure database, wherein the data processing system is configured to:

select, via the treatment procedure database, a treatment procedure from a plurality of treatment procedures, wherein the selected treatment procedure includes relative fluid concentrations and reaction periods;

request downhole parameters from one or more downhole sensors; and generate one or more fluid component transport and mixing schedules based, at least in part, on the downhole parameters and the reaction periods; and a mixing applicator that includes the first outlet positioned to provide a discharge path for the first fluid that at least partially intersects a flow path of the second fluid within a confluence region within the second conduit or in the wellbore.

2. The downhole treatment apparatus of claim 1, further comprising a coiled tubing tool string within which the second conduit is coextensively disposed in substantially parallel proximity with respect to the first conduit.

3. The downhole treatment apparatus of claim 1, wherein the first conduit is coextensively disposed within the second conduit.

4. The downhole treatment apparatus of claim 3, wherein the mixing applicator comprises an internal mixing sub in which the first outlet comprises one or more orifices in the first conduit and the second outlet comprises one or more orifices in the second conduit downstream of the one or more orifices in the first conduit.

5. The downhole treatment apparatus of claim 4, wherein each of the one or more orifices in the first conduit have a smaller surface area than a flow area through the first conduit.

6. The downhole treatment apparatus of claim 1, wherein the mixing applicator is included in a treatment tool on a tool string and is configured to discharge combined fluid components from the confluence region to a region external to the treatment tool.

7. The downhole treatment apparatus of claim 1, further comprising:

at least one flow control device configured to control flow of the first fluid through the first conduit and to control flow of the second fluid through the second conduit; and a flow control system configured to operate said at least one flow control device based, at least in part, on a downhole parameter and a treatment procedure.

8. The downhole treatment apparatus of claim 7, wherein the at least one flow control device comprises:

a first pump having an input port that receives the first fluid and an output port coupled to an inlet of the first conduit; and a second pump having an input port that receives the second fluid and an output port coupled to an inlet of the second conduit.

9. The downhole treatment apparatus of claim 1, wherein the mixing applicator includes a pressure-sensitive flow control component that blocks flow to the first outlet when a fluid pressure within the first conduit is below a threshold pressure.

10. The downhole treatment apparatus of claim 9, wherein the pressure-sensitive flow control component comprises a pressure-sensitive flapper valve, a pressure-sensitive spring valve, or a pressure-sensitive rupture disk valve.

11. A method for applying a multi-component treatment, said method comprising:

selecting, via a data processing system comprising a treatment procedure database, a treatment procedure from the treatment procedure database, wherein the selected treatment procedure includes relative fluid concentrations and reaction periods;

requesting, via the data processing system, downhole parameters from one or more downhole sensors;

generating, via the data processing system, one or more fluid component transport and mixing schedules based, at least in part, on the downhole parameters and the reaction periods;

transporting a first fluid from a surface of a wellbore through a first conduit to a first outlet positioned in the wellbore;

transporting a second fluid from the surface of the wellbore through a second conduit to a second outlet positioned in the wellbore; and combining the first and second fluids within a confluence region within the second conduit or in the wellbore after passing through a mixing applicator located downhole that includes at least a portion of a discharge flow path from the first outlet, wherein the mixing applicator includes a pressure-sensitive flow control component that blocks flow to the first outlet when a fluid pressure of the first conduit is below a threshold pressure;

determining that one or more of the downhole parameters have exceeded a threshold; and adjusting the one or more fluid component transport and mixing schedules based on the one or more downhole parameters that have exceeded the threshold.

12. The method of claim 11, wherein the first conduit and the second conduit are included in an injection string having the mixing applicator that includes the first outlet and the second outlet.

13. The method of claim 11, wherein the first and second fluids are loaded within the first and second conduits prior to initiation of downhole mixing during a treatment operation.

14. The method of claim 11, wherein said transporting the first and second fluids comprises:

transporting a volume of the first fluid based on a treatment procedure; and transporting a volume of the second fluid based on the treatment procedure.

15. The method of claim 14, wherein said transporting the volume of the first fluid comprises pumping the first fluid at a first rate, and wherein said transporting the volume of the second fluid comprises pumping the second fluid at a second rate determined based, at least in part, on the first rate.

16. The method of claim 14, wherein said combining the first and second fluids includes discharging the first fluid from the first outlet that is disposed in the confluence region within or external to the second conduit.

17. The method of claim 14, wherein selecting the treatment procedure from the treatment procedure database comprises:

receiving a treatment request; and selecting the treatment procedure from the treatment procedure database in response to the treatment request.

18. The method of claim 17, wherein the downhole parameter is at least one of the fluid pressure of the first conduit, a fluid pressure of the second conduit, and a downhole temperature.

19. The method of claim 17, wherein said transporting the volume of the second fluid based on the treatment procedure comprises initiating or terminating transport of the second fluid relative to initiating or terminating transport of the first fluid based, at least in part, on the transport and mixing schedule.

20. The method of claim 17, further comprising mixing the first and second fluids at a point during a treatment operation based on the transport and mixing schedule.

* * * * *